United States Patent [19]

Halter et al.

[11] 4,212,710

[45] Jul. 15, 1980

[54] ELECTROCHEMICAL OXIDATION OF ALKYL AROMATIC COMPOUNDS

[75] Inventors: Mark A. Halter, Schaumburg; Thomas P. Malloy, Lake Zurich, both of Ill.

[73] Assignee: UOP Inc., Des Plaines, Ill.

[21] Appl. No.: 52,645

[22] Filed: Jun. 27, 1979

[51] Int. Cl.[2] ..... C25B 3/02

[52] U.S. Cl. ..... 204/78

[58] Field of Search ..... 204/78

[56] References Cited

U.S. PATENT DOCUMENTS

| | | | |
|---|---|---|---|
| 729,502 | 5/1903 | Moest | 204/78 |
| 3,745,180 | 7/1973 | Rennie | 204/78 |

*Primary Examiner*—R. L. Andrews

*Attorney, Agent, or Firm*—James R. Hoatson, Jr.; Raymond H. Nelson; William H. Page, II

[57] ABSTRACT

Alkyl aromatic compounds may be subjected to electrochemical oxidation in an appropriate electrochemical cell utilizing an emulsion solution comprising said alkyl aromatic compound in an aqueous acidic medium which contains a salt of a transition metal. The reaction is effected at ambient temperature and atmospheric pressure utilizing an electrical energy which includes a voltage in the range of from 2 to about 30 volts or a current density in the range of from about 20 to about 1000 milliamps per square centimeter.

10 Claims, No Drawings

ELECTROCHEMICAL OXIDATION OF ALKYL AROMATIC COMPOUNDS

BACKGROUND OF THE INVENTION

Aromatic aldehydes which may be used in a variety of chemical reactions have, in the past, been prepared by various alternate reactions. For example, one method of preparing an aromatic aldehyde has been an air oxidation reaction in an oxygen enriched environment utilizing relatively high temperatures and pressures in combination with a transition metal catalyst such as cupric bromide. Another method of effecting the preparation of aromatic aldehydes is by the chemical oxidation of the substrate using stoichiometric quantities of an oxidizing agent which is obtained by way of non-electrochemical methods using concentrated sulfuric or perchloric acid, said reaction being effected at elevated temperatures. Yet another basic synthesis reaction for obtaining aromatic aldehydes is the chemical oxidation of the substrate using stoichiometric quantities of electrochemically generated oxidants such as salts of cobalt, manganese, or chromium in their highest valence state in a strongly acidic media at elevated temperatures. Reduced oxidant is then recycled, purified and electrolytically reoxidized back to its active state.

The inherent drawback in the last named reaction involves the reoxidation and recycling of the oxidant by electrochemical methods. Heretofore all of the methods which have been employed in this area have oxidized the transition metal to its higher valence state prior to combination of the same with the organic substrate in a conventional chemical reactor. In essence, this comprises a two step reaction which requires both an electrochemical reactor and a chemical reactor. In addition, the aforementioned processes have utilized relatively concentrated acids such as from 40 to 70% concentration of sulfuric acid or perchloric acid thus making the selectivites of these processes for activated alkyl aromatic systems less than desirable. The undesirability of these processes results from the tendency of the alkyl aromatic systems towards sulfonation or by-product formation.

As will hereinafter be set forth in greater detail, it has now been discovered that the oxidation of an alkyl aromatic compound may be effected by utilizing a process in which the alkyl aromatic compound is oxidized in the presence of a certain medium.

This invention relates to a process for the electrochemical oxidation of an alkyl aromatic compound. More specifically, the invention is concerned with a process for obtaining improved yields of desired compounds during the aforesaid process.

Alkyl aromatic compounds which have been oxidized to the corresponding aldehydes and alcohols will find a wide variety of uses in the chemical field. For example, anisaldehyde, and especially the para isomer, will find a use as a component in perfumes, colognes, scents, etc., and as an intermediate for pharmaceutical compounds such as antihistamines. Likewise, p-anisyl alcohol is also used in the fragrant field to impart light floral odors to colognes and perfumes.

It is therefore an object of this invention to provide a process for the electrochemical oxidation of alkyl aromatic compounds to form desirable oxidation products.

A further object of this invention is to provide a method for obtaining improved yields of desired oxidation products such as aldehydes and alcohols with a concommitant lesser amount of undesired side products being formed.

In one aspect an embodiment of this invention resides in a process for the electrochemical oxidation of an alkyl aromatic compound, the improvement which comprises effecting said eletrochemical oxidation in an electrochemical cell in the presence of an emulsion solution of said alkyl aromatic compound in an aqueous carboxylic acid medium containing a salt of a transition metal, and recovering the resultant oxidized aromatic compound.

A specific embodiment of this invention is found in a process for the electrochemical oxidation of an alkyl aromatic compound, the improvement which comprises effecting said electrochemical oxidation in an electrochemical cell at ambient temperature and atmospheric pressure in the presence of an emulsion solution of p-methoxytoluene in an aqueous acetic acid medium containing cobaltous acetate, utilizing electrical energy which includes a voltage in the range of from about 2 to about 30 volts and/or a current density in the range of from about 20 to about 1000 milliamps per square centimeter.

Other objects and embodiments will be found in the following further detailed description of the present invention.

As hereinbefore set forth the present invention is concerned with a process for the electrochemical oxidation of alkyl aromatic compounds whereby the desired oxidative products are obtained in an improved yield. The electrochemical oxidation process of the present invention comprises a pseudo-indirect oxidation of the alkyl aromatic compound. The process is effected by treating the alkyl aromatic compound to be oxidized with an electric current in an emulsion solution comprising an aqueous carboxylic acid and a salt of a transition metal which is capable of serving as a pseudo-indirect oxidant. The reaction is in a direct oxidation reaction inasmuch as there is no oxidation of the starting material when the salt of a transition metal is absent. Likewise, if the alkyl aromatic compound which is to be utilized, and which acts as the substrate, is combined with a salt of a transition metal in its highest valence state, no oxidation occurs in the event that no current is passed through the solution. However, in contradistinction to this, it has now been discovered that by utilizing emulsion solution comprising a mixture of water and a carboxylic acid, said solution containing a salt of a transition metal in a lower valence state, it is possible to oxidize the alkyl aromatic compound utilizing an electrical energy within the range hereinafter set forth in greater detail to form desired oxidation products comprising aldehydes and alcohol esters, the aldehyde being present in a relatively high ratio to the alcohol ester. In addition, the reaction products which are obtained by utilizing the system of the present invention will comprise only two identifiable products which differs from prior art processes in which the products which are recovered comprise at least three or more products. Therefore, the method of the pseudo-indirect oxidation of an alkyl aromatic compound of the present invention will provide the advantages of having a low rate of formation of undesired by-products, will be effected in a single-step process, will use a significantly less corrosive medium, use a simplified product separation and electrolyte recycle, give a high ratio of aldehyde to ester formation and operate the process at a lower overall cost.

The alkyl aromatic compounds which are used as starting materials for the electrochemical oxidation process of this invention and which possess an activating substituent on the ring thereof will include those compounds having the generic formula

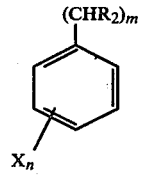

in which R is hydrogen or methyl radicals, X is independently selected from the group consisting of alkyl, alkoxy, hydroxy, primary amine, secondary amine, tertiary amine, benzyl and amide radicals, m is an integer of from 1 to about 4 and n is a radical of from 1 to 5 such as o-hydroxytoluene, m-hydroxytoluene, p-hydroxytoluene, o-methoxytoluene, m-methoxytoluene, p-methoxytoluene, o-ethoxytoluene, m-ethoxytoluene, p-ethoxytoluene, o-propoxytoluene, m-propoxytoluene, p-propoxytoluene, o-butoxytoluene, m-butoxytoluene, p-butoxytoluene, o-xylene, m-xylene, p-xylene, 1,2,3-trimethylbenzene, 1,3,5-trimethylbenzene, 1,2,4-trimethylbenzene, 1,2,3,4-tetramethylbenzene, pentamethylbenzene, o-ehtyltoluene, m-ethyltoluene, p-ethyltoluene, o-n-propyltoluene, m-n-propyltoluene, p-n-propyltoluene, o-isopropyltoluene, m-isopropyltoluene, p-isopropyltoluene, o-n-butyltoluene, m-n-butyltoluene, p-butyltoluene, o-t-butyltoluene, m-t-butyltoluene, p-t-butyltoluene, 3-methoxy-4-hydroxytoluene, 3-ethoxy-4-hydroxytoluene, o-hydroxyethylbenzene, m-hydroxyethylbenzene, p-hydroxyethylbenzene, o-methoxyethylbenzene, m-methoxyethylbenzene, p-methoxyethylbenzene, o-ethoxyethylbenzene, m-ethoxyethylbenzene, p-ethoxyethylbenzene, o-propoxyethylbenzene, m-propoxyethylbenzene, p-propoxyethylbenzene, o-butoxyethylbenzene, m-butoxyethylbenzene, p-butoxyethylbenzene, 1,2-diethylbenzene, 1,3-diethylbenzene, 1,4-diethylbenzene, 2-propylethylbenzene, 3-propylethylbenzene, 4-propylethylbenzene, 2-t-butylethylbenzene, 3-t-butylethylbenzene, 4-t-butylethylbenzene, 2-hydroxymethylnaphthalene, 3-hydroxymethylnaphthalene, 4-hydroxymethylnaphthalene, 2-methoxymethylnaphthalene, 3-methoxymethylnaphthalene, 4-methoxymethylnaphthalene, 2-ethoxymethylnaphthalene, 3-ethoxymethylnaphthalene, 4-ethoxymethylnaphthalene, 2-propoxymethylnaphthalene, 3-propoxymethylnaphthalene, 4-propoxymethylnaphthalene, 1,2-dimethylnaphthalene, 1,3-dimethylnaphthalene, 1,4-dimethylnaphthalene, 2-ethylmethylnaphthalene, 3-ethylmethylnaphthalene, 4-ethylmethylnaphthalene, 5-ethylmethylnaphthalene, o-toluidine, m-toluidine, p-toluidine, o-ethylaniline, m-ethylaniline, p-ethylaniline, o-isopropylaniline, m-isopropylaniline, p-isopropylaniline, o-n-butylaniline, m-n-butylaniline, p-n-butylaniline, o-methyl-N-methylaniline, m-methyl-N-methylaniline, p-methyl-N-methylaniline, o-methyl-N,N-dimethylaniline, m-methyl-N,N-dimethylaniline, p-methyl-N,N-dimethylaniline, o-methyl-N,N-diethylaniline, m-methyl-N,N-diethylaniline, p-methyl-N,N-diethylaniline, o-benzyltoluene, m-benzyltoluene, p-benzyltoluene, o-benzylethylbenzene, m-benzylethylbenzene, p-benzylethylbenzene, etc. It is to be understood that the aforementioned alkyl substituted aromatic compounds which contain an activated substituent on the ring thereof are only representatives of the class of compounds which may be employed, and that the present invention is not necessarily limited thereto.

The electrochemical oxidation of the aforementioned alkyl aromatic compounds is accomplished by utilizing a reaction medium comprising an emulsion solution of an aqueous carboxylic acid. The carboxylic acids which are employed will contain from 1 to about 15 or more carbon atoms in which the amount of carboxylic acid present in the aqueous solution will range from about 5% to about 80%. Representative examples of the carboxylic acids which are employed will include fatty acids such as formic acid, acetic acid, propionic acid, butyric acid, valeric acid, caproic acid, enanthylic acid, caprylic acid, pelargonic acid, capric acid, undecylic acid, lauric acid, tridecoic acid, myristic acid, pentadeconoic acid, palmitic acid, etc.; dibasic carboxylic acids such as oxalic acid, malonic acid, succinic acid, glutaric acid, adipic acid, palmitic acid, suberic acid, axelaic acid, sebacic acid, etc., diphenyl acetic acid, diphenyl propionic acid, etc. In the preferred embodiment of the invention the carboxylic acid which is employed will comprise a fatty acid containing from 1 to about 6 carbon atoms. It is to be understood that the aforementioned acids are only representative of the carboxylic acids which may be employed and that the present invention is not necessarily limited thereto.

The emulsion solution will also contain a compound capable of acting as a pseudo-indirect oxidant. These compounds will comprise salts of transition metals and particularly salts of cobalt, cerium, chromium, manganese, iron, lead and silver in which the metal is present in its lowest valence state. Some representative examples of these salts of transition metals will include cobaltous formate, cobaltous acetate, cobaltous propionate, cobaltous butyrate, cobaltous valerate, cobaltous hexanoate, cobaltous acetylacetonate, cobaltous sulfate, cobaltous chloride, cobaltous nitrate, cobaltous bromide, cobaltous iodide, cobaltous fluoride, cerous formate, cerous acetate, cerous propionate, cerous butyrate, cerous valerate, cerous hexanoate, cerous acetylacetonate, cerous sulfate, cerous chloride, cerous nitrate, cerous bromide, cerous iodide, cerous fluoride, chromous formate, chromous acetate, chromous propionate, chromous butyrate, chromous valerate, chromous hexanoate, chromous acetylacetonate, chromous sulfate, chromous chloride, chromous nitrate, chromous bromide, chromous iodide, chromous fluoride, manganous formate, manganous acetate, manganous propionate, manganous butyrate, manganous valerate, manganous hexanoate, manganous acetylacetonate, manganous sulfate, manganous chloride, manganous nitrate, manganous bromide, manganous iodide, manganous fluoride, as well as the corresponding iron, lead and silver salts in which the metal is present in its lowest valence state.

The electrochemical cell in which the electrochemical oxidation of the alkyl aromatic compound is effected may be of any variety which is well known in the art. The electrodes which are employed in the cell may be formed of any conductive material such as a carbon anode and a stainless steel cathode, a ruthenized titanium dioxide-based anode, and a copper cathode, etc., although it is also contemplated that other conductive materials may also be utilized. The oxidation reaction is effected utilizing an electrical energy which includes a voltage within the range of from about 2 to about 30 volts and/or a current density in the range of from about 20 to about 1000 milliamps/cm$^2$. In the preferred embodiment of the invention, the reaction is effected in a divided electrolytic cell using an environmentally stable anion exchange membrane. The anolyte solution will comprise the emulsion solution hereinbefore discussed while the catholyte solution will comprise an aqueous acidic solution containing a buffer salt. The acid in the catholyte will preferably be the same as that used in the anolyte solution and the buffer salt will preferably comprise an alkali or alkaline earth metal salt of the acid. A specific example of the type of anolyte solution which may be employed will comprise an aqueous acetic acid solution containing sodium acetate.

The process of this invention may be effected in any suitable manner and may comprise either a batch or continuous type of operation. When a batch type of operation is employed, an emulsion solution which will include the alkyl aromatic compound, the carboxylic acid, the salt of a transition metal which serves as a pseudo-indirect oxidant, and water is placed in a divided electrolytic cell as the anolyte solution. The catholyte solution of the type hereinbefore set forth in placed in the other portion of the electrolytic cell, each section of the cell containing the suitably chosen electrodes. The cell is then subjected to an electrical energy within the range hereinbefore set forth for a predetermined period of time which may range from about 0.5 up to about 10 hours or more in duration. Upon completion of the desired residence time, the mixture is withdrawn from the cell and subjected to conventional means of operation which may include decantation, washing, drying, fractional distillation, etc., whereby the desired products comprising aldehydes and alcohol esters are separated from unreacted starting materials and recovered.

It is also contemplated within the scope of this invention that electrochemical oxidation of the alkyl aromatic compound may be effected in a continuous manner of operation. When such a type of operation is used, the aforementioned components of the reaction mixture are continuously charged to an electrochemical cell as the anolyte solution, said cell being maintained at the proper operating conditions of temperature and pressure, the preferred conditions including ambient temperature and atmospheric pressure. After cycling through the cell and being subjected to an electrical charge for a predetermined period of time, the effluent is continuously withdrawn and subjected to conventional means of separation similar in nature to those hereinbefore set forth whereby the desired products comprising aldehydes and alcohol esters are recovered, while any unreacted alkyl aromatic compound as well as other components of the emulsion system are recycled.

The following examples are given to illustrate the process of this invention. However, it is to be understood that these examples are given merely for purposes of illustration and that the present invention is not merely limited thereto.

EXAMPLE I

The anolyte in this example was prepared by dissolving 50 grams (0.2 mole) of cobaltous acetate in 150 grams of water and thereafter adding 150 grams of acetic acid. The catholyte was prepared by adding 37 grams of sodium acetate to 150 grams of water followed by the addition of 150 grams of acetic acid. Thereafter the catholyte was cooled to room temperature by means of an ice bath. The anolyte solution and catholyte solution were added to the respective reservoir in an electrochemical cell which was provided with a ruthenized titanium dioxide based DSA anode and a copper cathode, the division between the two reservoirs bein an anionic exchange membrane sold under the tradename Ionac 3475. Thereafter, 73.2 grams (0.6 mole) of p-methoxytoluene was slowly added to the anolyte solution. The electrical energy which was used consisted of an E applied voltage ranging from 21 to 23 volts along with about 2.0 amps while maintaining the current density at a rate of about 40 milliamps/cm$^2$. In addition, the reaction was run at ambient temperature and atmospheric pressure. The solution was passed through the cell and condenser and back to the cell by use of a pump. The reaction was run for a period of 6 hours at the end of which time the gas liquid chromatographic analysis disclosed a ratio of anisaldehyde to p-anisyl alcohol acetate ester of 82:18. Analysis also disclosed that there had been a 16.2% conversion of p-methoxytoluene with current efficiencies of 50–70% being observed.

EXAMPLE II

The above experiment was repeated using a mixture of 50 grams of cobaltous acetate, 150 grams of acetic acid and 150 grams of water as the anolyte solution while the catholyte solution consisted of 32 grams of a 50% sodium hydroxide solution, 174 grams of acetic acid and 128 grams of water. After placing the solutions in their respective reservoirs of an electrochemical cell similar in nature to that described in Example I above, 73.2 grams of p-methoxytoluene was slowly added to the anolyte solution. As in the above experiment, the electrical energy which was used consisted of an E applied voltage ranging from 21 to 26 volts along with about 2.0 amps while maintaining the current density at a rate of about 50 milliamps/cm$^2$. At the end of a 6 hour period during which time the reaction was effected at ambient temperature and atmospheric pressure, the respective solutions were recovered and washed with methylene chloride. The washes were combined and along with the solutions were subjected to gas liquid chromatographic analysis. This analysis determined that there has been a current yield of 28% consisting of about an 82:18 ratio of anisaldehyde to p-anisyl alcohol acetate ester with an estimated current efficiency of 100%.

EXAMPLE III

In a manner similar to that set forth in the above examples, an emulsion solution containing equal amounts of propionic acid and water along with about 0.2 mole of chromous oxide may be placed in one reservoir of an electrochemical cell as an anolyte solution while an aqueous solution of propionic acid and sodium propionate may be placed in the other reservoir of said cell as a catholyte solution. Following this, p-methoxytoluene may be slowly added to the anolyte and after addition has been completed an electrical energy may be applied to the cell, said electrical energy using an E applied voltage of from 10 to about 15 volts and 2.0 amps while maintaining the current density at about 50 milliamps/cm$^2$. Upon completion of a 6 hour reaction period the desired products comprising an anisaldehyde and p-anisyl alcohol propionate ester may be recovered therefrom. The obtention of the aldehyde and alcohol ester may also be effected using other transition metal salts such as cerous nitrate and manganous phosphate as the pseudo-indirect oxidant.

We claim as our invention:

1. In a process for the electrochemical oxidation of an alkyl aromatic compound, the improvement which comprises effecting said electrochemical oxidation in an electrochemical cell in the presence of an emulsion solution of said alkyl aromatic compound in an aqueous carboxylic acid medium containing a salt of a transition metal, and recovering the resultant oxidized aromatic compound.

2. The process as set forth in claim 1 being effected at ambient temperature and atmospheric pressure.

3. The process as set forth in claim 1 in which said electrochemical oxidation is effected utilizing electrical energy which includes a voltage in the range of from about 2 to about 30 volts or a current density in the range of from about 20 to about 1000 milliamps per square centimeter.

4. The process as set forth in claim 1 in which said salt of a transition metal is cobaltous acetate.

5. The process as set forth in claim 1 in which said salt of a transition metal in chromous oxide.

6. The process as set forth in claim 1 in which said salt of a transition metal is cerous nitrate.

7. The process as set forth in claim 1 in which said salt of a transition metal is manganous phosphate.

8. The process as set forth in claim 1 in which said aqueous acid medium is an aqueous solution of acetic acid.

9. The process as set forth in claim 1 in which said aqueous acid medium is an aqueous solution of propionic acid.

10. The process as set forth in claim 1 in which said alkyl aromatic compound is p-methoxytoluene and said oxidized aromatic compound is a mixture of anisaldehyde and p-anisyl alcohol acetate ester.

* * * * *